US009328463B2

(12) United States Patent
Zhou et al.

(10) Patent No.: US 9,328,463 B2
(45) Date of Patent: May 3, 2016

(54) SURFACE SIZING COMPOSITION FOR PRINT MEDIA IN DIGITAL PRINTING

(75) Inventors: Xiaoqi Zhou, San Diego, CA (US); Gracy Apprisiani Wingkono, San Diego, CA (US); David Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/884,247

(22) PCT Filed: Nov. 17, 2010

(86) PCT No.: PCT/US2010/057095
§ 371 (c)(1),
(2), (4) Date: May 8, 2013

(87) PCT Pub. No.: WO2012/067615
PCT Pub. Date: May 24, 2012

(65) Prior Publication Data

US 2013/0235118 A1 Sep. 12, 2013

(51) Int. Cl.

| | |
|---|---|
| ***D21H 21/16*** | (2006.01) |
| ***D21H 17/20*** | (2006.01) |
| ***D21H 17/63*** | (2006.01) |
| ***D21H 19/44*** | (2006.01) |
| ***B41M 5/52*** | (2006.01) |
| ***D21H 19/38*** | (2006.01) |

(Continued)

(52) U.S. Cl.
CPC ..... *D21H 21/16* (2013.01); *B41M 5/52* (2013.01); *D21H 17/74* (2013.01); *D21H 19/385* (2013.01); *D21H 19/40* (2013.01); *D21H 19/62* (2013.01); *D21H 19/64* (2013.01); *D21H 19/84* (2013.01); *D21H 23/56* (2013.01)

(58) Field of Classification Search
USPC ..... 162/135, 184, 158, 175, 162, 168.1, 162/181; 106/162.1, 400, 206.1, 401, 106/207.5, 461, 214.1–214.2, 217.1, 491, 106/217.6, 499, 466–468, 481–483; 428/32.1–32.11, 32.21, 32.3, 428/32.34–32.35
See application file for complete search history.

(56) References Cited

U.S. PATENT DOCUMENTS 5,246,774 A * 9/1993 Sakaki et al. ..... 428/323
5,460,645 A 10/1995 Pandian et al.

(Continued)

FOREIGN PATENT DOCUMENTS

CN 1109412 A 10/1995
CN 1826394 A 8/2006

(Continued)

OTHER PUBLICATIONS

J. Peel, Paper Science & Paper Manufacture 1999, pp. 18-19.*

(Continued)

*Primary Examiner* — Dennis Cordray
(74) *Attorney, Agent, or Firm* — Elizabeth E. Leitereg

(57) ABSTRACT

A size press (SP) surface sizing composition provides a SP surface sizing for a print medium that is used in a digital printing system. The surface sizing composition includes an aqueous mixture including a macromolecular material in an amount from about 25% to about 75% dry weight; an inorganic metallic salt in an amount from about 3% to about 20% dry weight; and an amount of inorganic pigment ranging from at least 16% to about 60% dry weight, such that a total dry weight equals about 100%.

14 Claims, 2 Drawing Sheets

(51) Int. Cl.

| | |
|---|---|
| ***D21H 19/40*** | (2006.01) |
| ***D21H 19/62*** | (2006.01) |
| ***D21H 19/64*** | (2006.01) |
| ***D21H 19/84*** | (2006.01) |
| ***D21H 23/56*** | (2006.01) |
| ***D21H 17/00*** | (2006.01) |

(56) References Cited

U.S. PATENT DOCUMENTS

| | | | | |
|---|---|---|---|---|
| 6,048,439 | A | 4/2000 | Huang et al. | |
| 6,057,404 | A | 5/2000 | Utecht et al. | |
| 6,150,289 | A * | 11/2000 | Chen et al. | 501/148 |
| 6,207,258 | B1 | 3/2001 | Varnell | |
| 6,350,507 | B1 | 2/2002 | Iwamoto et al. | |
| 6,764,726 | B1 | 7/2004 | Yang et al. | |
| 7,381,300 | B2 | 6/2008 | Skaggs et al. | |
| 7,582,188 | B2 | 9/2009 | Stoffel et al. | |
| 7,618,701 | B2 | 11/2009 | Zhou | |
| 8,431,193 | B2 * | 4/2013 | Romano et al. | 428/32.21 |
| 2002/0185239 | A1 | 12/2002 | Kimpimaki et al. | |
| 2004/0023004 | A1 | 2/2004 | Kimpimaki et al. | |
| 2004/0255820 | A1 | 12/2004 | Chen et al. | |
| 2005/0157146 | A1 | 7/2005 | Kondo et al. | |
| 2005/0233098 | A1 * | 10/2005 | Asano et al. | 428/32.34 |
| 2007/0087138 | A1 | 4/2007 | Koenig et al. | |
| 2007/0125267 | A1 * | 6/2007 | Song et al. | 106/214.1 |
| 2008/0173420 | A1 * | 7/2008 | Song et al. | 162/175 |
| 2008/0289786 | A1 * | 11/2008 | Koenig et al. | 162/164.1 |
| 2009/0131570 | A1 * | 5/2009 | Schliesman et al. | 524/426 |
| 2009/0165977 | A1 | 7/2009 | Huang | |
| 2009/0297738 | A1 * | 12/2009 | Song et al. | 428/32.3 |
| 2009/0317549 | A1 * | 12/2009 | Tan et al. | 427/288 |
| 2010/0086709 | A1 | 4/2010 | Huang et al. | |
| 2011/0011547 | A1 * | 1/2011 | Song | B41M 5/0035 162/168.1 |
| 2012/0123027 | A1 * | 5/2012 | Zhou et al. | 524/53 |

FOREIGN PATENT DOCUMENTS

| | | | |
|---|---|---|---|
| CN | 101056955 | A | 10/2007 |
| CN | 102383335 | A | 3/2012 |
| EP | 0652324 | A1 | 10/1995 |
| JP | 2003260865 | A | 9/2003 |
| JP | 2008230898 | | 10/2008 |
| WO | 2006049545 | A1 | 5/2006 |
| WO | WO-2007/053681 | | 5/2007 |

OTHER PUBLICATIONS

Smook, Gary A., Handbook for Pulp and Paper Technologists, 2nd ed, Angus Wilde Publications, 1992, pp. 324.*

International Search Report and Written Opinion of the International Searching Authority (ISA/KR), dated Aug. 18, 2011 (9 pages) for counterpart PCT Patent Application PCT/US2010/057095.

Office Action and Search Report (CNOA/SR) (14 pages) and English translation of Search Report (2 pages) from the State Intellectual Property Office (SIPO) of People's Republic of China (PRC) dated Jul. 1, 2014 for foreign (CN) counterpart application No. 201080070215.0 in PRC.

* cited by examiner

SURFACE SIZING COMPOSITION FOR PRINT MEDIA IN DIGITAL PRINTING

CROSS-REFERENCE TO RELATED APPLICATIONS

N/A

STATEMENT REGARDING FEDERALLY SPONSORED RESEARCH OR DEVELOPMENT

N/A

BACKGROUND

Printing techniques can be broadly categorized into two groups: analog and digital. Common analog techniques are offset lithography, flexographic, gravure and screen printing. Inkjet and electrophotographic printing are the most prevalent digital technologies. Digital printing has an advantage over its analog counterpart in that printed output can be digitally altered, meaning that every printed page can be different. To change the printed output of an analog printer, a new set of imaging plates or stencils must be produced. Digital printing methods are more cost effective at low run lengths (number of pages), whereas at large page counts analog printing may be more economical. Print quality is another vector of comparison between printing methods. Analog prints often have had superior image quality and typically have operated at higher printing speeds, but digital printing is approaching the quality and printing speed of analog printing with the advancement of printer hardware, printing inks and printing media.

Since the mid-1980s electrophotographic (EP) printing, commonly known as laser printing, has been a popular choice among consumers who demand high quality, professional looking printed communications. State-of-the-art commercial EP printers now have image quality that rivals lithographic offset printers.

Inkjet printers are now common and affordable and allow one to obtain photographic quality albeit at lower printing speed. They are used in home printing, office printing and more recently, in commercial printing. Key advantages for inkjet technology in the commercial printing market are that printing width can be easily scaled and high print speeds are possible.

Printing media used in digital printing have various affects on printing attributes such as printing quality, printer durability and reliability and printing speed that are important attributes to printer manufacturers and end users. The challenge for the manufacturers of printing media is to produce printing products that can maintain these printing attributes in an optimum status.

BRIEF DESCRIPTION OF THE DRAWINGS

The various features described herein may be more readily understood with reference to the following detailed description taken in conjunction with the accompanying drawings, where like reference numerals designate like structural elements, and in which.

Figure 1:
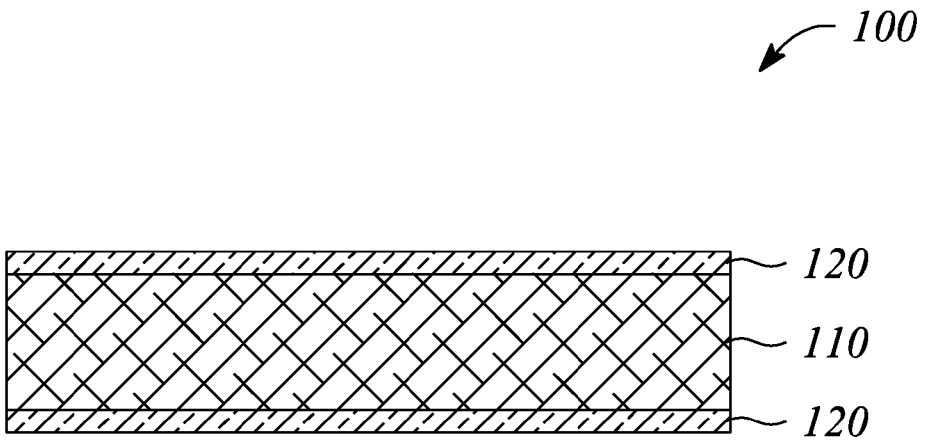
FIG. 1 illustrates a side view of an example of a print medium in accordance with the principles described herein.

Certain examples have other features that are one of in addition to and in lieu of the features illustrated in the above-referenced figures. These and other features are detailed below with reference to the preceding drawings.

DETAILED DESCRIPTION

Examples of a surface sizing composition, a print medium that includes the surface sizing composition and a digital printing system that includes the print medium are described herein. Moreover, examples of a method of making the surface sizing composition and a method of making the print medium are described herein. The surface sizing composition is a formulated aqueous mixture that includes a macromolecular material, an inorganic pigment and an inorganic salt, wherein an amount of the inorganic pigment replaces an amount of the macromolecular material relative to commercially available surface sizing compositions. The print medium includes a cellulose-based paper sized with the surface sizing composition for digital printing and the digital printing system includes one of inkjet technology, dry electrophotography (EP), and liquid EP.

The surface sizing composition is also referred to herein as a size press (SP) surface sizing composition. By definition, the 'SP surface sizing composition' or 'SP surface sizing' is applied, or intended for application, directly on a surface of a cellulose-based paper web during an online surface sizing process using a size press of paper manufacturing equipment (i.e., a paper machine). In an online surface sizing process during paper manufacture, a solution that comprises at least a material with large molecular weight (i.e., a 'macromolecular material') is applied to a surface of the paper web with a size press. Examples of the SP surface sizing composition and the method of making a print medium according to the principles described herein are differentiated from a paper coating that is generally added to a manufactured paper with an off-line coater in a paper coating process. For example, paper coatings are applied offline with a separate coater at a coat speed of less than 800 meters/minute (m/min.) having a dry coat weight of at least 5 grams per square meter (gsm) or more per side of the paper and a viscosity that is greater than about 1000 centipoise (cP). In contrast, the SP surface sizing composition according to the principles herein are applied online with the size press of the paper making machine or equipment at paper manufacturing speeds of no less than 800 m/min., and as much as 3,500 m/min., for example, with a lower coat dry weight of less than 5 gsm per side of the paper web and a lower viscosity of less than about 200 cP. Moreover, examples of the SP surface sizing composition and the method of making a print medium according to the principles described herein are differentiated from internal filler and internal sizing during paper manufacturing that are described further below.

The cellulose paper web can be made of any suitable wood or non-wood pulp. Non-limitative examples of suitable pulp compositions include, but are not limited to, mechanical wood pulp, chemically ground pulp, chemi-mechanical pulp, thermo-mechanical pulp (TMP) and combinations of one or more of the above. In some examples, the cellulose paper web comprises a bleached hardwood chemical kraft pulp. The bleached hardwood chemical kraft pulp contains more than 70% by weight, for example, of hardwood fibers in total fiber content, which has a shorter fiber structure (about 0.3 to about 0.6 mm length) than soft wood pulp. The shorter fiber structure contributes to good formation of the paper product in roll or sheet form, for example.

Moreover, a filler may be incorporated into the pulp, for example, to substantially control physical properties of the paper product in roll or sheet form. Particles of the filler fill in the void spaces of the fiber network and substantially result in a denser, smoother, brighter and opaque sheet than without a filler. The filler may substantially reduce cost also, since filler is generally cheaper than the pulp itself. Examples of fillers that are incorporated into the pulp include, but are not limited to, ground calcium carbonate, precipitated calcium carbonate, titanium dioxide, kaolin clay, silicates, plastic pigment, alumina trihydrate and combinations of any of the above. An amount of the filler in the pulp may include as much as 20 percent (%) by weight, for example. In some examples, the amount of filler in the pulp ranges from about 0% to about 20% of the paper product in roll or sheet form. In another example, the amount of filler ranges from about 5% to about 15% of the paper product in roll or sheet form. In some examples, if the percentage of filler is more than 20% by weight, pulp fiber-to-fiber bonding may be reduced, which subsequently may decrease stiffness and strength of the resulting paper product in roll or sheet form.

Moreover, an internal sizing may be included, for example. Internal sizing may improve internal bond strength of the pulp fibers, and also may control resistance of the paper product in roll or sheet form to wetting, penetration, and absorption of aqueous liquids. Internal sizing processing may be accomplished by adding a sizing agent to a fiber furnish (or source of the pulp fiber) in the wet end of paper manufacture. Non-limitative examples of suitable internal sizing agents include a rosin-based sizing agent, a wax-based sizing agent, a cellulose-reactive sizing agent and another synthetic sizing agent, and combinations or mixtures thereof. The degree of internal sizing may be characterized by Hercules Sizing Test (HST) value. In some examples, the cellulose-based paper web has an internal sizing with a low HST value ranging from 1 to 50 (i.e., a soft internal sizing). In some examples, the HST value ranges from about 1 to about 10. Excessive internal sizing may affect the print quality on the paper product, for example, it may cause color-to-color bleed of inks printed on the paper product.

As used herein, the article 'a' is intended to have its ordinary meaning in the patent arts, namely 'one or more'. For example, 'a filler' generally means one or more fillers and as such, 'the filler' means 'the filler(s)' herein. The phrase 'at least' as used herein means that the number may be equal to or greater than the number recited. The term 'about' as used herein means that the number recited may differ by plus or minus 20%, for example, 'about 5' means a range of 4 to 6. The term 'between' when used in conjunction with two numbers such as, for example, 'between about 2 and about 50' includes both of the numbers recited. Any ranges of values provided herein include values within or between the provided ranges. The term 'substantially' as used herein means a majority, or almost all, or all, or an amount with a range of about 51% to 100%, for example. Also, any reference herein to 'top', 'bottom', 'upper', 'lower', 'up', 'down', 'left' or 'right' is not intended to be a limitation herein. Moreover, examples herein are intended to be illustrative only and are presented for discussion purposes and not by way of limitation.

The surface sizing composition according to the principles described herein comprises a macromolecular material, either natural or synthetic, in an amount from about 25% to about 75% dry weight; an inorganic metallic salt in an amount from about 3% to about 20% dry weight; and an amount of an inorganic pigment ranging from greater than 15% to about 60% dry weight in an aqueous mixture, such that a total dry weight equals about 100%. The aqueous mixture is a size press (SP)-applied surface sizing composition in online paper manufacture. In particular, the SP surface sizing composition according to the principles described herein has one or more of a lower content of macromolecular material, a lower content of salt and a higher content of inorganic pigment (filler) than a surface sizing of commercially available office printing paper in the marketplace. In some examples, the SP surface sizing composition according to the principles described herein has each of a lower content of macromolecular material, a lower content of salt and a higher content of inorganic pigment (filler) than the commercially available office printing paper.

The macromolecular material is a high molecular weight material, such as a high molecular weight polymeric material, that functions as both a sizing agent and a binder for the SP surface sizing composition. In some examples, the macromolecular material includes one or both of synthetic polymers and natural polymers. In particular, by definition, the macromolecular material one or more of is water-soluble or water dispersible, has strong film forming capability, and can bind particles of the inorganic pigment to form a continuous layer. Moreover, by definition, the macromolecular material is inert to the inorganic metallic salt. The term 'film-forming' as used herein means that, during drying, or i.e., when aqueous solvent is removed from the cellulose-based paper web, the macromolecules can form continuous network, or latex particles can aggregated together to form a continuous film, or a continuous barrier layer to the aqueous solvent or moisture at a macroscopic level. The term 'inert' as used herein means that the macromolecular material will not interact with a fixative so as to cause the polymers to be precipitated, gelled, or form any kind of solid particle, which would adversely reduce a binding capability of the macromolecular material and a spreading ability of the SP surface sizing composition.

Examples of a synthetic polymer useful in the macromolecular material include, but are not limited to, polyvinyl alcohol, polyvinyl pyrrolidone, acrylic latex, styrene-butadiene latex, polyvinyl acetate latex, and a copolymer latex of any of the above-named monomers, and combinations or mixtures thereof. Examples of a natural polymer useful in the macromolecular material include, but are not limited to, casein, soy protein, a polysaccharide, a cellulose ether, an alginate, a virgin starch and a modified starch, and a combination of any of the above named polymers. The starch species includes, but is not limited to, corn starch, potato starch, and wheat starch, and derivatized starches and modified starches including, but not limited to, ethylated starch, oxidized starch, anionic starch, and cationic starch. For example, an ethylated starch, such as K96F from Grain Processing Corp., Muscatine, Iowa, or a hydroxyethyl ether derivatized corn starch, such as Penford® 280 Gum (i.e., 2-hydroxyethyl starch ether, hydroxyethyl starch or ethylated starch) from Penford Products Co., Cedar Rapids, Iowa, may be used.

In some examples, the amount in dry weight of the macromolecular material in the aqueous mixture ranges from about 25% to about 70%, or about 30% to about 60%, or about 30% to about 55%, or about 30% to about 50%, or about 30% to about 45%, or about 35% to about 60%, or about 40% to about 60%, or about 45% to about 60%, or about 50% to about 60%, or about 55% to about 75%, or about 30% to about 55%, or about 35% to about 55%, or about 40% to about 55%, or about 45% to about 55%. In some examples, the amount in dry weight of the macromolecular material is about 33%, or about 41%, or about 45%, or about 54%, or about 72%. In some examples, the amount of the macromolecular material substantially equals the amount of inorganic pigment in the aqueous mixture. In some examples, the amount of inorganic pigment is greater than the amount of macromolecular material in the aqueous mixture.

The inorganic pigment may be any kind of inorganic white filler. Examples of inorganic pigments that may be used include, but are not limited to, aluminum silicate, kaolin clay, a calcium carbonate, silica, alumina, boehmite, mica and talc, and combinations or mixtures thereof. In some examples, the inorganic pigment includes a clay or a clay mixture. In some examples, the inorganic pigment includes a calcium carbonate or a calcium carbonate mixture. The calcium carbonate may be one or more of ground calcium carbonate (GCC), precipitated calcium carbonate (PCC), modified GCC, and modified PCC, for example. Moreover, other combinations of any of the inorganic pigments described herein may be used. For example, the inorganic pigment may include a mixture of a calcium carbonate and a clay. In another example, the inorganic pigment may include two different calcium carbonates (e.g., GCC and PCC). In an example, a calcium carbonate, e.g., OMYAJET® C440 (GCC) from Omyajet AG Aktiengesellschaft, Switzerland, may be used. In another example, a calcium carbonate, e.g., ALBAGLOS® S (a 0.6 micron PCC) from Minerals Technologies, Inc., NY, may be used. In another example, an aluminosilicate clay, e.g., ZEOCROS® PF/S from INEOS Silicas, Joliet, Ill., may be used.

In some examples, the inorganic pigment materials of the SP surface sizing composition are substantially the same as the internal filler described above used in wet end paper manufacture. When the inorganic pigment of the SP surface sizing composition is substantially the same as the internal filler, one or both of cost savings and lower manufacturing complexity may be realized. For example, using one or both of GCC and PCC as the inorganic pigment in the SP surface sizing composition at the size press and as the internal filler at the wet-end of paper manufacture may provide one or both of lower prices through volume leveraging and similar storage and supply systems.

The inorganic pigment comprises particles of the respective filler material. An average particle size of the inorganic pigment particles in the SP surface sizing composition ranges from about 0.1 to about 3 microns, for example. In some examples, the average particle size ranges from about 0.5 to about 1.5 microns. In some examples, the inorganic pigment particles have a particle size distribution represented by an index of particle size distribution (I), a size ratio according to the following formula:

$$I=(D85/D15)^{1/2}$$

where D85 is the average particle size in micrometers (m) for which about 85% of the particles of the inorganic pigment are smaller by size than this value according to a distribution curve, and where D15 is the average particle size for which about 15% of the particles of the inorganic pigment are smaller in size than this value. For example, the index of particle size distribution (I) may be in a range of from about 1 to about 10. In other examples, the index of particle size distribution (I) may be in the range of from about 1 to about 9, about 1 to about 8, or about 1 to about 7, or about 1 to about 6, or about 1 and about 5, or about 1 to about 4, or from about 1.5 and about 4.

In some examples, the amount in dry weight of inorganic pigment in the aqueous mixture ranges from about 8% to about 60%, or about 9% to about 60%, or about 10% to about 50%, or at least 16% to about 60%, or about 20% to about 60%, or about 25% to about 50%, or about 30% to about 50%, or about 35% to about 50%, or about 40% to about 50%, or about 45% to about 50%, or about 45% to about 60%. In some examples, the amount in dry weight of inorganic pigment is about 9%, or about 27%, or about 41%, or about 45%, or about 49% dry weight.

In some examples, the inorganic pigment comprises a plurality of pigment filler materials. For example, the inorganic pigment may comprise a first pigment filler material, such as a calcium carbonate, and a second pigment material, different from the first pigment filler material. For example, the second pigment filler material may be any organic or inorganic pigment with a micro-porous structure, or which can form a micro-porous structure during solidification on a surface of the cellulose-based paper during paper manufacture. In particular, a solidified micro-porous structure on the cellulose-based paper becomes an image receiving layer or surface. By 'image receiving layer or surface' it is meant a surface of a print medium that is adapted to receive an ink from a digital printer, for example. Representative examples of pigment filler materials (e.g., that facilitate the image receiving layer) include calcium carbonate, zeolite, silica, talc, alumina, aluminum trihydrate (ATH), calcium silicate, kaolin, calcined clay, and combinations or mixtures of any of these.

The first pigment filler material may be provided in a ratio of about 3:1 to about 20:1 to the second pigment filler material. For example, the first pigment filler material may be provided in the amount in dry weight ranging from about 24% to about 36% and the second pigment filler material may be provided in an amount in dry weight ranging from about 8% to about 12%. In another example, the first pigment filler material may be provided in the amount in dry weight ranging from about 25% to about 35% and the second pigment filler material may be provided in an amount in dry weight ranging from about 5% to about 7%. In another example, the first pigment filler material may be provided in the amount in dry weight ranging from about 30% to about 40% and the second pigment filler material may be provided in an amount ranging from about 3% to about 4%. In some examples, the first pigment filler is a calcium carbonate material and the second pigment filler is either a different calcium carbonate material or an aluminosilicate clay material.

In some examples, the inorganic metallic salt is a multivalent metal salt of metals from Group 2 or 3 of the Standard Period Table of Elements that is soluble in an aqueous mixture having a pH from between about 7 and about 12. In some examples, a metal halide salt, for example a metal chloride or metal bromide salt, may be used. In other examples, a metal nitrate salt may be used. Non-limitative examples of the inorganic metallic salt include calcium chloride ($CaCl_2$), magnesium chloride ($MgCl_2$), aluminum chloride, beryllium chloride, calcium nitrate, magnesium nitrate, aluminum nitrate, and beryllium nitrate, and combinations or mixtures thereof.

In some examples, the amount in dry weight of inorganic metallic salt in the aqueous mixture ranges from about 5% to about 20%, or about 6% to about 20%, or about 7% to about 20%, or about 8% to about 20%, or about 9% to about 20%, or about 9% to about 19%, or about 9% to about 15%, or about 10% to about 20%, or about 12% to about 20%, or about 15% to about 20%, or about 17% to about 20%, or about 18% to about 20%, or about 18% to about 19%, or about 9% to about 17%, or about 10% to about 15%. In some examples, the amount in dry weight of inorganic metallic salt is between 9% and 9.5%, or between 18% and 18.5%, or between 18.5% and 19%, or between 19% and 19.5%. In some examples, a monovalent metallic salt may be used either instead of or in a mixture with the multivalent salt. However, at least when used instead of the multivalent salt, the monovalent salt is provided in an amount that is greater than the amounts provided above for the multivalent salt to achieve a similar print quality (print quality is described further below), because the monovalent salt has a lower efficiency than the multivalent salt. For example, a halide salt of a monovalent metal from Group 1 of the Standard Periodic Table may be used.

The aqueous mixture of the surface sizing composition has a pH that ranges from about 7 to about 12. In some examples, the pH of the aqueous mixture is between about 7.5 and about 12.5, or between about 8 and about 11, or between about 8.5 and about 11.5, or between about 9 and about 10.5, or between about 9.5 and about 12.5, or between about 10 and about 12, for example. In some examples, the pH of the aqueous mixture is about 8.5 to about 12, or about 9 to about 11, or about 9.5 to about 10.5, or about 10 to about 11.

The aqueous mixture of the surface sizing composition has a target solids content that ranges from about 10% to about 25% dry weight. In some examples, the actual solids content in dry weight ranges from about 11% to about 23%, or about 12% to about 22%. In some examples, the actual solids content is between 12% and 12.5%, or between 13% and 14%, or between 13.5% and 14%, or between 22% and 22.5%.

Moreover, the aqueous mixture of the surface sizing composition has a viscosity that ranges from about 10 cP to about 200 cP, as measured with a Brookfield viscometer, Brookfield Engineering Laboratories, MA, at 100 rpm spindle speed at room temperature. In some examples, the viscosity ranges from about 15 cP to about 190 cP, or about 20 cP to about 180 cP, or about 25 cP to about 170 cP, or about 30 cP to about 160 cP, or about 35 cP to about 170 cP, or about 40 cP to about 160 cP, or about 45 cP to about 150 cP, or about 50 cP to about 140 cP, or about 55 cP to about 130 cP, or about 60 cP to about 120 cP. In some examples, the viscosity is lower than or equal to about 100 cP, or lower than or equal to about 75 cP, or lower than or equal to about 50 cP, or between about 50 cP and about 100 cP.

In some examples, other chemical functional additives also may be added to the SP surface sizing composition. These chemicals include, but are not limited to, optical brightness agents (OBA), surfactants, levering agents, biocides, and polymeric dispersing agents.

An example of a print medium in accordance with the principles described herein is illustrated in FIG. 1 in side view. The print medium (100) comprises a cellulose-based paper (110) and a size press (SP) surface sizing (120) on the cellulose-based paper (110). The SP surface sizing (120) is substantially the SP surface sizing composition described above with substantially all the water removed (i.e., dried on print medium surface) that was applied online during paper manufacture using a size press and then dried. The SP surface sizing (120) in the print medium (100) has a dried weight that ranges from about 1.0 gram per square meter (gsm) to about 3.0 gsm per side of the print medium. In some examples, the dried weight of the SP surface sizing (120) is less than about 3.0 gsm per side, for example less than about 2.8 gsm per side. In some examples, the dried weight of the SP surface sizing (120) ranges from about 1.2 gsm to about 3.0 gsm per side, or about 1.4 gsm to about 2.8 gsm per side, about 1.5 gsm to about 2.7 gsm per side, or 1.7 gsm to about 2.6 gsm per side, or about 1.8 gsm to about 2.5 gsm per side, or about 2 gsm to about 3 gsm per side, or about 1.5 gsm to about 2.5 gsm per side, or about 1 gsm to about 2 gsm per side.

The cellulose-based paper web (110) has a Hercules Sizing Test (HST) value that ranges from about 1 second to about 50 seconds. In some examples, the HST value ranges from about 1 second to about 25 seconds, or about 1 second to about 15 seconds. The cellulose-based paper (110) has a Hercules Sizing Test (HST) value of less than about 20 seconds, for example. Lower HST values may translate into enhanced pick up and penetration of the SP surface sizing composition into the cellulose-based paper web. Moreover, lower HST values may translate into improved dry EP printing and less color-to-color bleed in dye-based inkjet printing. For example, the print medium (100) comprising a cellulose-based paper web (110) having an HST value of greater than about 20 seconds, when printed with ink, will start to show a feathering or bleeding effect along color-to-color boundaries, which is visible to a common observer. However, when the cellulose-based paper web (110) has an HST of less than about 20 seconds, for example, such feathering or bleeding effect on the print medium (100) would not be visible to the common observer.

Figure 2:
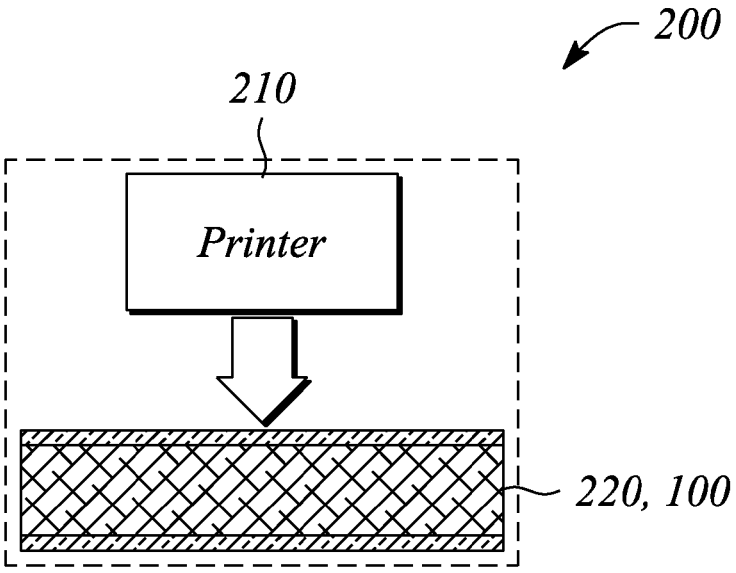
FIG. 2 illustrates a block diagram of an example of a digital printing system in accordance with the principles described herein.

An example of a digital printing system according to the principles described herein is illustrated in FIG. 2 in block diagram. The digital printing system (200) is a direct type printing system that comprises means (210) for depositing an imaging material and a print medium (220) to receive the imaging material directly from the deposition means (210). The term 'imaging material' herein is intended to mean either ink or toner and may be referred to herein as 'ink' for simplicity of discussion only. The print medium (220) that receives the ink is substantially the same as the print medium (100) described above. The direct type digital printing system (200) excludes analog printing, for example offset type printing, where an ink is deposited on an intermediate receiving surface and then is transferred from the intermediate surface to print media. In some examples, the means (210) for depositing the imaging material includes an inkjet printer (210), a dry EP printer (i.e., laser printer) (210) or a liquid EP (LEP) printer (210).

The imaging material deposited from the deposition means (210) includes dye-based inks and pigment-based inks, including colors such as Cyan (C), Magenta (M), Yellow (Y), and Black (K), which are precisely intermingled in dot form to create thousands of other colors. In some examples, the pigment-based inks include pigment particles that may be coated with or encapsulated in an organic polymer. The organic polymer may improve adhesion between the pigment and the print medium (220).

Examples of organic pigments that may be present in the ink include, but are not limited to, perylenes, phthalocyanine pigments (for example, phthalo green, phthalo blue), cyanine pigments (Cy3, Cy5, and Cy7), naphthalocyanine pigments, nitroso pigments, monoazo pigments, disazo pigments, disazo condensation pigments, basic dye pigments, alkali blue pigments, blue lake pigments, phloxin pigments, quinacridone pigments, lake pigments of acid yellow 1 and 3, isoindolinone pigments, dioxazine pigments, carbazole dioxazine violet pigments, alizarine lake pigments, vat pigments, phthaloxy amine pigments, carmine lake pigments, tetrachloroisoindolinone pigments, perinone pigments, thioindigo pigments, anthraquinone pigments and quinophthalone pigments, and mixtures of two or more of the above and derivatives of the above.

Inorganic pigments that may be present in the ink, include, but are not limited to, metal oxides (for example, titanium dioxide, iron oxides (e.g., red iron oxide, yellow iron oxide, black iron oxide and transparent iron oxides), aluminum oxides, silicon oxides), carbon black pigments (e.g., furnace blacks), metal sulfides, metal chlorides, and mixtures of two or more thereof.

Figure 3:
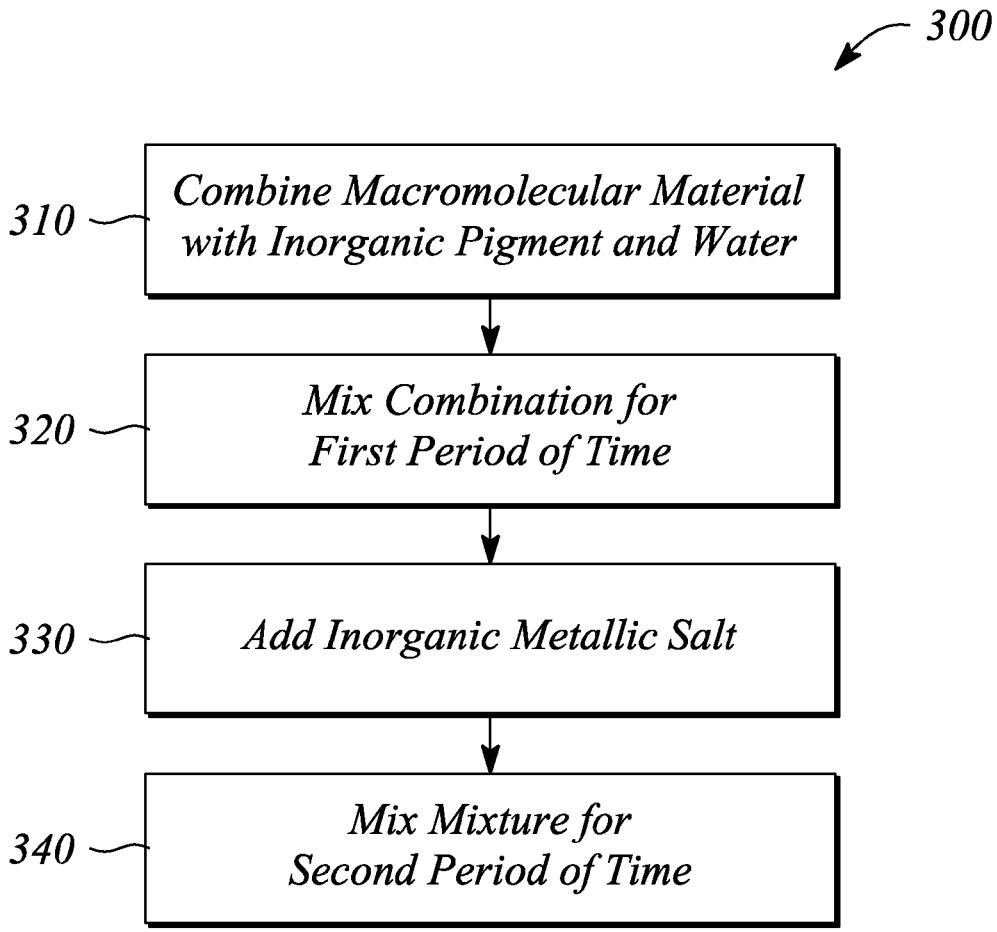
FIG. 3 illustrates a flow chart of an example of a method of making a surface sizing composition in accordance with the principles described herein.

An example of a method of making the surface sizing composition according to the principles described herein is illustrated in FIG. 3 as a flow chart. The method (300) of making the composition comprises combining (310) an amount ranging from about 25% to about 75% dry weight of a macromolecular material with an inorganic pigment and water to form an aqueous combination. For example, the macromolecular material is placed into a mixing tank, and an amount ranging from greater than 15% to about 60% dry weight of the inorganic pigment is added to the tank with the macromolecular material. In some examples, at least 16% to about 50% of inorganic pigment is added to the tank with about 30% to about 55% of the macromolecular material. Water is also added. In some examples, the macromolecular material is a starch. The starch may be precooked before being added to the mixing tank. For example, between about 25% to about 75% dry weight of the starch may be precooked by heating to about 90° C. for about 30 minutes to form a solution. The precooked starch solution is then added to the mixing tank with the inorganic pigment and water.

The method (300) of making the composition further comprises mixing (320) the aqueous combination for a first period of time. For example, the aqueous combination is mixed (320) at room temperature for the first period of time ranging from about 15 minutes to about 45 minutes. In some examples, the first period time ranges from about 20 minutes to about 40 minutes, or about 25 minutes to about 35 minutes. For example, the first period of time may be about 30 minutes.

The method (300) of making the composition further comprises adding (330) an inorganic metallic salt to the aqueous combination after the first period of time to form a mixture. For example, an amount ranging from about 3% to about 20% dry weight of the inorganic metallic salt is added (330) to the aqueous combination while mixing or stirring the aqueous mixture. For example, an amount of about 9% to about 19% of a multivalent salt is added (330) to the aqueous combination. The method (300) further comprises mixing (340) the mixture for a second period of time to form the surface sizing composition. For example, the mixture is mixed (340) at room temperature for the second period of time ranging from about 5 minutes to about 20 minutes. In some examples, the second period time ranges from about 10 minutes to about 20 minutes, or about 10 minutes to about 15 minutes. For example, the second period of time may be about 10 minutes.

During mixing (340) the mixture, the pH, solids content and viscosity of the mixture is checked and adjusted during mixing until one or more of the pH is between 7 and about 12, the target solid content is between about 10% to about 25%, and the viscosity ranges from about 10 cP to about 200 cP, for example. In some examples, adjusting for pH comprises adding sodium hydroxide (NaOH) and checking pH. In some examples, adjusting for solids content and adjusting for viscosity comprises one or both of adding water and increasing one or both of mixing time and mixing power or speed, for example. In some examples, the mixture is mixed (340) until all of the pH, the target solids content and the viscosity of the surface sizing composition are within the stated ranges.

Figure 4:
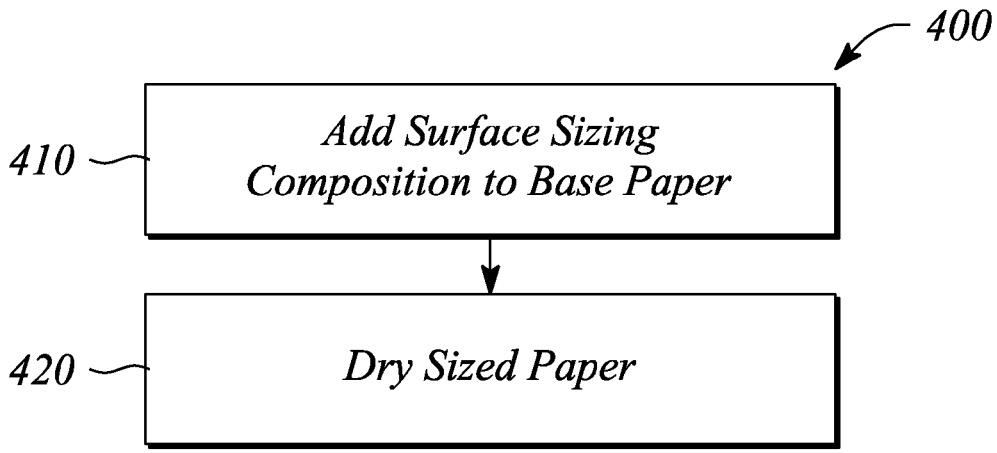
FIG. 4 illustrates a flow chart of an example of a method of making a print medium in accordance with the principles described herein.

An example of a method of making a digital print medium according to the principles described herein is illustrated in FIG. 4 as a flow chart. The method (400) of making the print medium comprises adding (410) the surface sizing composition to a cellulose-based paper web during online paper manufacturing using a size press. In particular, the addition (410) of the SP surface sizing composition to the paper web herein is integral and contemporaneous with the paper manufacturing process and equipment. It is not an independent or separate coating step, or applied with a separate piece of equipment, for example a coater or the like, after the dry-end section of paper manufacturing, or after the paper is dried.

The method (400) of making a digital printing medium further comprises drying (420) the sized paper to form the print medium. In some examples, a weight of the surface sizing on the print medium ranges from about 1.5 grams per square meter (gsm) to about 3.0 gsm per side of the dried paper. The aqueous SP surface sizing composition is added (410) to the paper web in an amount ranging from about 15 gsm to about 30 gsm wet weight per side to achieve about 1.5 gsm to about 3.0 gsm dry weight per side after drying (420) the sized paper to form the print medium, for example. Drying (420) is performed by the paper manufacturing equipment using standard parameters for the equipment.

DEFINITIONS

The following provides definitions for terms and phrases used herein, which are not otherwise defined herein.

'Wet end' of paper manufacturing refers to a web-forming section of a paper machine where a slurry of fibers, fillers, and other additives are combined and formed into a continuous web of fibers that is wet.

'Dry end' of paper manufacturing refers to herein a press section and a drying section of a paper machine, both located after the wet end. The press section includes a 'size press' where the continuous web of fibers passes between rollers of the size press under pressure to squeeze out water. The drying section includes heating cylinders where the sized-continuous web of fiber passes through to be dried further. Surface sizing is applied with the size press at the dry end of paper manufacturing.

EXAMPLES

A variety of surface sizing composition samples were prepared and evaluated on print media. Each sample comprised an aqueous mixture of a macromolecular material, an inorganic metallic salt and an inorganic pigment in accordance with the principles described herein. The samples differed by one or both of using different amounts of the materials and different inorganic pigment materials. Table 1 lists the prepared surface sizing composition samples, their ingredients and amounts thereof as well as a target solids content value and an actual solids content value. Unless otherwise indicated, parts and percentages are by weight and temperature is room temperature unless indicated otherwise.

TABLE 1

Prepared surface sizing samples. The samples are listed in columns with the ingredients and their amounts listed in rows. All amounts are in percent (%) dry weight.

| | SAMPLES: | | | | | | |
|---|---|---|---|---|---|---|---|
| INGREDIENTS: | SP-1 | SP-2 | SP-3 | SP-4 | SP-5 | DP-1 | DP-2 |
| Penford ® 280 Starch | 71.75 | 54.13 | 40.77 | 32.69 | 45.35 | 40.77 | 40.77 |
| Calcium Chloride | 19.28 | 18.81 | 18.45 | 18.27 | 9.30 | 18.45 | 18.45 |

TABLE 1-continued

Prepared surface sizing samples. The samples are listed in columns with the ingredients and their amounts listed in rows. All amounts are in percent (%) dry weight.

| | SAMPLES: | | | | | | |
|---|---|---|---|---|---|---|---|
| INGREDIENTS: | SP-1 | SP-2 | SP-3 | SP-4 | SP-5 | DP-1 | DP-2 |
| Albaglos ® S PCC | 8.97 | 27.06 | 40.77 | 49.04 | 45.35 | 30.58 | 30.58 |
| Zeocros ® PF/S Clay | | | | | | 10.19 | |
| Omyajet ® C4440 GCC | | | | | | | 10.19 |
| TOTAL (approx.) | 100.0 | 100.0 | 100.0 | 100.0 | 100.0 | 100.0 | 100.0 |
| Target solids (%) | 12.0 | 12.0 | 12.0 | 12.0 | 22.0 | 13.0 | 13.0 |
| Actual solids (%) | 12.4 | 12.6 | 12.4 | 12.4 | 22.3 | 13.7 | 13.8 |

The surface sizing samples were prepared in accordance with an example of the method (300) of making a surface sizing composition described above. In particular for each sample in Table 1, a macromolecular material, e.g., Penford® 280 starch, in the amount indicated for each of the respective samples in Table 1 was precooked and the starch solution was added to a mixing tank. The respective amount(s) in Table 1 of inorganic pigment(s), as a slurry or powder, was combined with the precooked starch solution in the tank and water was added. The aqueous combination was mixed for a first period of time of about 30 minutes. The respective amount in Table 1 of calcium chloride ($CaCl_2$) inorganic metallic salt, supplied by Hydrite Chemicals, Brookfield, Wis., was then added to the tank and mixed with the aqueous combination for a second period of time of about 10 minutes to form the surface sizing composition.

Print medium samples were made from the surface sizing samples in Table 1 using an example of the method (400) of making a digital print medium in accordance with the principles described herein. The samples were tested in a variety of print quality tests and printer durability tests and all performed well and substantially the same. For example, surface sizing samples were each separately applied to a cellulose-based paper having a low HST of less than or equal to about 5 seconds to make Print Medium Samples. The cellulose-based paper web comprised a bleached hardwood chemical kraft pulp from Glatfelter, York, Pa. A metered size press Model Optisizer from Metso Corp., Finland, was used to apply the surface sizing samples to the base paper media. Immediately after the size press, the sized paper was dried in a dryer section. The dryer section included an air-turn, followed by an infrared (IR) dryer, and followed by dryer hot air tunnel drying. The applied composition in an amount of about 15 to about 30 gsm wet weight was sufficient to provide an amount of about 1.5 gsm to about 3.0 gsm weight per side on the cellulose-based paper to form the print medium samples. The Print Medium Samples are identified in groups in Table 2. For example, data and results for Print Medium Samples prepared from each of SP-1, SP-2, SP-3 and SP-4 sizing compositions are grouped together as EXP-1, for simplicity of discussion. The data and results for the Print Medium Sample SP-5 are identified as EXP-2 and for Print Medium Samples DP-1 and DP-2 as EXP-3.

Comparative samples were also provided. Table 2 further lists four comparative sample types used to compare to the Print Medium Samples. The loading of respective surface sizing ingredients are indicated in kilograms of ingredient per metric ton of paper (kg/T), which represents the amount of the respective ingredients picked up by (or put on) the paper samples. The ingredients were normalized from a measured quantity of salt ions in the compositions using ion chromatography analysis (standard method). Comparative Sample CP-1 represented commercially available paper media, for example an office printing paper available at office supply stores (e.g., Staples, CA), characterized by having a high macromolecular material content, no inorganic pigment and a high inorganic salt content in its surface sizing relative to the Print Medium Samples. Comparative Sample CP-4 also represented commercially available paper media, an office printing paper also available at office supply stores (e.g., Staples, CA), characterized by having a high macromolecular material content, no inorganic pigment and no salt content in its surface sizing. Comparative Sample CP-4 functioned as a control sample ('Control') for the testing that was performed. Comparative Samples CP-2 and CP-3 were prepared in a manner similar to the Print Medium Samples. The sizing on Comparative Sample CP-2 had a high macromolecular material content (starch), a low inorganic pigment content and a high salt content in its surface sizing relative to the Print Medium Samples. The sizing on Comparative Sample CP-3 had a moderate macromolecular material content (starch), a high inorganic pigment content and a high salt content in its surface sizing relative to the Print Medium Samples. The Comparative Samples CP-2 and CP-3 represented higher-than-threshold and lower-than-threshold samples for various ingredients of the surface sizing as a comparison.

TABLE 2

Prepared print medium samples and comparative samples and their respective ingredients. All amounts are loading on paper in kg of ingredient/metric Ton of paper.

| | SAMPLES | | | | | | |
|---|---|---|---|---|---|---|---|
| | EXP-1 | EXP-2 | EXP-3 | CP-1 | CP-2 | CP-3 | CP-4 |
| INGREDIENTS (loading in kg/T): | | | | | | | |
| Modified Starch | 13 | 34 | 13 | 40 | 38.5 | 18.5 | 47.5 |
| Calcium Chloride | 7 | 7 | 6 | 7.5 | 7.5 | 7.5 | |
| Salt | | | | | | | |
| Inorganic Pigment: | | | | | | | |
| Albaglos ® S PCC | 19 | 34 | 10 | | | | |
| Omyajet ® C440 GCC or Zeocros ® PF/S Clay | | | 3 | | 1.5 | 20 | |
| OBA: | 2 | 2 | 2 | 2 | 2 | 2 | 2 |
| Other additives: | 0.5 | 0.5 | 0.5 | 0.5 | 0.5 | 0.5 | 0.5 |

The Print Medium Samples EXP-1, EXP-2 and EXP-3 were tested in a variety of tests and compared to the comparative samples CP-1, CP-2, CP-3 and CP-4 in Table 2 to evaluate print quality performance. For example, a high temperature/high humidity (H/H) EP print quality (PQ) stress test was performed at about 30° C. and about 80% relative humidity. This PQ stress test exposed the Print Medium Samples to relatively severe or extreme environmental conditions during color laser printing. The EP print quality stress test evaluated for toner transfer defects using HP Color Laser printers Models CP4525, and CP5220, from Hewlett-Packard Co., Palo Alto, Calif. The EP print quality was rated using visual reference to check for missing spots on printed areas of both the Print Medium Samples and the Comparative Samples due to defects in toner transfer. The ratings included A=no defect; B=minor defect; C=noticeable defect to consumer; D=severe defect; and E=very severe defect.

Table 3 summarizes the print quality results for the EP print quality stress test at high temperature/high humidity (H/H) for the Print Medium Samples, which are grouped together in Table 3 for simplicity of discussion, because they performed substantially the same, and Comparative Samples CP-1 and CP-4 (representing existing commercial paper and the Control).

TABLE 3

Summary of Laser Print Quality Stress Testing at 30° C. and 80% RH.

| Media Type | Visual Defect Rating | EP Printer |
|---|---|---|
| Comparative Sample, CP-1 | E | HP CP4525 |
| Print Medium Samples | B | HP CP4525 |
| Comparative Sample, CP-4 | B | HP CP4525 |
| Comparative Sample, CP-1 | E | HP CP5220 |
| Print Medium Samples | C | HP CP5220 |
| Comparative Sample, CP-4 | C | HP CP5220 |

Visual Defect Ratings: A = no defect; B = minor defect; C = noticeable defect to consumer; D = severe defect; and E = very severe defect.

In particular, the Print Medium Samples showed superior PQ for color EP printing at H/H condition compared to Comparative Sample CP-1 and Comparative Sample CP-4 (control). Both Samples CP-1 and CP-4 represent existing paper in marketplace. While not intending to be limited to this reason, Comparative Sample CP-1 appeared to showed the effect of high salt content in the paper on laser printing, which is believed to affect electrical properties of the paper and thus, the transfer of toner, resulting in the worst toner transfer defect using the HP CP4525 and HP CP5220 printers compared to the control Comparative Sample CP-4, which has no salt content. Moreover, the Print Medium Samples showed performance at the same level as the Control Sample CP-4 despite the presence of salt in the Print Medium Samples (see Tables 1 and 2 for salt content). Table 4 below also summarizes the EP print quality stress test results in relative terms for all of the comparative samples and for the Print Medium Samples, as well as provides summaries for additional tests described below.

In another example, a print quality test using an inkjet printer was performed on the comparative samples and Print Medium Samples of Table 2. Color pigment inks were printed on the paper samples using a lab test-bed inkjet printer (TIJ) at 23° C. and 50% relative humidity with TAPPI environmental conditions. A pattern of solid fill areas was printed with different color inks to evaluate color gamut volume, print density and bleed between color-to-color boundary areas. The results of the Inkjet PQ test are provided in Table 4 in relative terms. A 'Best' rating means substantially no visible defects, a 'Good' rating means minor visible defects, a 'Fair' rating means acceptable level of visible defects, and a 'Bad' rating means unacceptable level of visible defects. The inkjet print quality on Comparative Samples CP-1, CP-2 and CP-3, each with a high salt content, was good relative to the bad inkjet print quality on the Control Sample, CP-4, which had no salt content. In comparison, the Print Medium Samples, which had a medium salt content relative to the comparative samples, had the best inkjet print quality. Each of the Print Medium Samples performed substantially the same and therefore, the Samples are reported as a single group in Table 4 also for simplicity of discussion. While not intending to be limited to this reason, this print quality performance is believed to be due to the moderate presence of salt in Print Medium Samples, for example, relative to the comparative samples. Moreover, relative to the Control Comparative Sample, CP-4, the Print Medium Samples show better inkjet print quality and substantially the same EP print quality (stress test results).

In another example, the presence of dusting is evaluated for the samples. For example, about 50,000 sheets of each Sample are printed with the laser printer and dust accumulated inside the laser printer is monitored by visual observation after each Sample is printed. Table 4 summarizes the results of the dusting evaluation. Only Comparative Sample CP-3, which was relatively high in both inorganic pigment content and salt content, had a dusting issue, which may impact printer performance, for example.

TABLE 4

Summary of print quality (PQ) results using inkjet printing versus using EP printing, Black (K) Optical Density (KOD), as well as presence of Dusting for the Comparative Samples and the Print Medium Samples from Table 2.

| | SAMPLES | | | | |
|---|---|---|---|---|---|
| TEST and RESULT: | CP-1 | CP-2 | CP-3 | CP-4 | Print Medium Samples |
| PQ with InkJet printing | Good | Good | Good | Bad | Best |
| PQ with EP printing at H/H condition | Bad | Bad | Bad | Fair | Fair |
| Dusting | None | None | YES | None | None |
| KOD with InkJet | 1.54 | 1.53 | 1.56 | 1.05 | 1.55 |

In another example, Black (K) Optical Density (KOD) measurements were made on the Print Medium Samples and the Comparative Samples. The KOD measures the black optical density of pigment ink on the respective print medium using the TIJ printer. The KOD was measured by a Spectrodensitometer Model 938, supplied by X-rite, Green Rapids, Mich. The setting used was ANSI status A and the comparative results are reported for an average of three measurements. The KOD measurements showed that lower macromolecular material loading in the sample gives a higher KOD measurement (See Table 2 for starch loading). The KOD results also show that the Print Medium Samples (as a group) had better print quality with inkjet printing using pigmented ink, as exhibited by a higher black optical density (KOD), compared to Comparative Samples CP-1, CP-2, CP-3 and CP-4. Both color gamut volume and color saturation are expected to follow the KOD results.

In another example, laser runnability tests were run to compare loading levels of filler (i.e., inorganic pigment) in the comparative samples and in the print medium samples for dry EP printing applications. For example, about 50,000 pages of each of the Print Medium Samples were run through the HP Model CP3525 laser printer. No premature damage was observed for the fuser roll of the CP3525 printer and no runnability issue including, but not limited to, paper jamming, was observed for the Print Medium Samples. This runnability result from the Print Medium Samples was comparable to 50,000 sheets of Comparative Samples CP-1 and CP-4, which are commercially available paper in the marketplace, for example, run through the same laser printer.

The substantially equal performance among the Print Medium Samples in the variety of tests described above demonstrates a robustness of the many examples of the SP sizing composition and the print medium in accordance with the principles herein. The inorganic pigment in the SP surface sizing composition partially replaces possibly one of the highest cost materials in surface sizing at the size press, namely the macromolecular material, compared to commercially available paper in the marketplace. In addition, reducing the inorganic metallic salt content while still maintaining the print quality level described above may also reduce raw material costs, reduce corrosion risk and improve print quality in H/H dry EP. Excessive salt may cause higher corrosivity in white water, for example, which may negatively impact the expected lifetime or service time of the paper manufacturing equipment also. Salt is likely to be hygroscopic, therefore excess moisture attracted by the salt may cause significant changes in electrical properties of paper as well and therefore, may impact toner transfer during printing, as demonstrated by the results provided above. With reduced salt, dry EP print quality in the H/H condition may be significantly improved, as was further demonstrated by the Print Medium Samples herein.

Thus, there have been described various examples of a surface sizing composition, a print medium that includes the surface sizing composition and a digital printing system that includes the print medium. Further, various examples of method of making the composition and the print medium are described. It should be understood that the above-described examples are merely illustrative of some of the many specific examples that represent the principles described herein. Clearly, those skilled in the art can readily devise numerous other arrangements without departing from the scope of the various examples as defined by the following claims.

What is claimed is:

1. A print medium for digital direct printing, the print medium consisting of:

a cellulose-based paper; and a size press (SP) surface sizing on the cellulose-based paper, the SP surface sizing consisting of:

one macromolecular material in an amount ranging from about 40% to about 70% by dry weight;

an inorganic pigment in an amount ranging from about 9% to about 45% by dry weight, wherein the inorganic pigment is substantially equal to or less than an amount of the macromolecular material in percent dry weight; and an inorganic metallic salt in an amount ranging from 9% to 19% dry weight, such that a total dry weight equals about 100%;

wherein a weight of the SP surface sizing in the print medium ranges from about 1.5 grams per square meter (gsm) to about 3 gsm per side;

and wherein the cellulose-based paper consists of a hardwood pulp and one or both of internal filler and internal sizing, the cellulose-based paper having a Hercules Sizing Test (HST) value less than about 20 seconds.

2. The print medium of claim 1, wherein the amount of the inorganic pigment ranges from about 9% to about 30% by dry weight.

3. The print medium of claim 1, wherein the amount of the macromolecular material ranges from about 40% to about 45% by dry weight, and the amount of the inorganic pigment ranges from about 40% to about 45% by dry weight.

4. The print medium of claim 1, wherein the amount of the macromolecular material substantially equals the amount of the inorganic pigment, and the amount of the inorganic metallic salt ranges from about 9% to about 18.5% by dry weight.

5. The print medium of claim 1, wherein the amount of the macromolecular material is greater than the amount of the inorganic pigment, and the amount of the inorganic metallic salt ranges from 18% to 19% by weight.

6. The print medium of claim 1, wherein the inorganic pigment comprises a plurality of pigment fillers, a first pigment filler being a calcium carbonate, a second pigment filler being one of a different calcium carbonate and a clay, a ratio of the first pigment filler to the second pigment filler ranging from about 3:1 to about 20:1.

7. The print medium of claim 1, wherein the macromolecular material is selected from an ethylated starch, an anionic starch and a cationic starch, and wherein the inorganic metallic salt is selected from a halide of a metal from Group 2 or 3 of the Standard Periodic Table of Elements, and wherein the inorganic pigment is selected from one or more of a clay, a calcium carbonate and an aluminum silicate clay.

8. The print medium of claim 1, wherein one of:

i) a loading of the inorganic metallic salt on the cellulose-based paper is 6 kg/metric ton of the cellulose-base paper;

a loading of the inorganic pigment on the cellulose-based paper is 10 kg/metric ton of the cellulose-base paper; and a loading of the one macromolecular material on the cellulose-based paper is 13 kg/metric ton of the cellulose-base paper; or ii) a loading of the inorganic metallic salt on the cellulose-based paper is 7 kg/metric ton of the cellulose-base paper;

a loading of the inorganic pigment on the cellulose-based paper is 34 kg/metric ton of the cellulose-base paper; and a loading of the one macromolecular material on the cellulose-based paper is 34 kg/metric ton of the cellulose-base paper.

9. The print medium of claim 1 wherein the inorganic pigment has an index of particle size distribution ranging from about 1 to about 10, the index of particle size distribution being represented by $(D85/D15)^{1/2}$, wherein D85 is a particle size in microns for which about 85% of the inorganic pigments are smaller than and D15 is an other particle size in microns for which about 15% of the inorganic pigments are smaller than, and wherein the inorganic pigment has an average particle size that ranges from about 0.1 microns to about 3 microns.

10. A method of making the print medium of claim 1, the method comprising:

selecting as the inorganic pigment an inorganic pigment having an average particle size that ranges from about 0.1 microns to about 3 microns and an index of particle size distribution ranging from about 1 to about 10, the index of particle size distribution being represented by $(D85/D15)^{1/2}$, wherein D85 is a particle size in microns for which about 85% of the inorganic pigments are smaller than and D15 is an other particle size in microns for which about 15% of the inorganic pigments are smaller than;

combining the macromolecular material and the inorganic pigment with water to form an aqueous combination such that an amount in percent dry weight of the macromolecular material substantially equals or is greater than an amount in percent dry weight of the inorganic pigment, wherein the amount of the macromolecular material ranges from about 40% to about 70% by dry weight and the amount of the inorganic pigment ranges from about 9% to about 45% by dry weight;

mixing the aqueous combination for a first period of time;

adding an amount from 9% to 19% dry weight of the inorganic metallic salt to the aqueous combination after the first period of time to form a mixture;

mixing the mixture for a second period of time to form the surface sizing having one or more of a pH between about 7 and 12, a target solid content of about 10% to about 25%, and a viscosity ranging from about 10 centipoise (cP) to about 200 cP measured at room temperature and 100 rpm; and adding the SP surface sizing to the cellulose-based paper during paper manufacturing using an online size press.

11. A method of making the print medium of claim 1, the method comprising:

adding the SP surface sizing to the cellulose-based paper during paper manufacturing using an online size press of paper manufacturing equipment; and drying the SP surface sized paper in a drying section of the paper manufacturing equipment.

12. The method of claim 11, wherein the adding of the SP surface sizing to the cellulose-based paper using the online size press occurs at a speed of no less than 800 m/min.

13. A digital printing system, comprising:

a digital printer to deposit an imaging material; and a print medium to receive the imaging material directly from the digital printer, the print medium consisting of a size press (SP) surface sizing on a cellulose-based paper, the SP surface sizing consisting of:

one macromolecular material in an amount ranging from about 40% to about 70% dry weight;

an inorganic metallic salt in an amount ranging from about 9% to about 19% dry weight; and an inorganic pigment in an amount ranging from about 9% to about 45% dry weight, such that a total dry weight equals about 100%, wherein the amount of macromolecular material is substantially equal to or greater than the amount of the inorganic pigment;

wherein a weight of the SP surface sizing in the print medium ranges from about 1.5 grams per square meter (gsm) to about 3 gsm per side of the cellulose-based paper;

and wherein the cellulose-based paper consists of a hardwood pulp and one or both of internal filler and internal sizing, the cellulose-based paper having a Hercules Sizing Test (HST) value less than about 20 seconds.

14. The digital printing system of claim 13, wherein the digital printer is either an inkjet printer or a laser printer.

* * * * *